US005570685A

United States Patent [19]

Turiello

[11] Patent Number: 5,570,685

[45] Date of Patent: Nov. 5, 1996

[54] BREATHING AIR REPLENISHMENT CONTROL SYSTEM

[75] Inventor: Anthony J. Turiello, Redwood City, Calif.

[73] Assignee: Rescue Air Systems, Inc., San Carlos, Calif.

[21] Appl. No.: 443,951

[22] Filed: May 18, 1995

[51] Int. Cl.[6] ..... A62B 7/00

[52] U.S. Cl. ..... 128/202.13; 128/205.24; 128/205.25; 128/205.26; 128/204.18

[58] Field of Search ..... 128/202.13, 202.17, 128/205.25, 205.26, 205.28, 200.24, 200.25, 205.24, 204.18

[56] References Cited

U.S. PATENT DOCUMENTS

| | | | |
|---|---|---|---|
| 1,040,311 | 10/1912 | Halloran . | |
| 2,299,793 | 10/1942 | Cannaday et al. | 128/140 |
| 2,855,926 | 10/1958 | Koppelman | 128/203 |
| 4,165,738 | 8/1979 | Graves et al. | 128/202.13 |
| 4,168,706 | 9/1979 | Lovell | 128/205.28 |
| 4,331,139 | 5/1982 | Popa | 128/202.13 |
| 4,353,292 | 10/1982 | Almasi et al. | 128/202.13 |
| 4,380,187 | 4/1983 | Wicks | 454/342 |
| 4,467,796 | 8/1984 | Beagley | 128/200.24 |
| 4,862,931 | 9/1989 | Vella | 128/202.13 |
| 5,095,899 | 3/1992 | Green | 128/200.25 |
| 5,396,885 | 3/1995 | Nelson | 128/205.24 |

*Primary Examiner*—Edgar S. Burr
*Assistant Examiner*—V. Srivastava
*Attorney, Agent, or Firm*—Skjerven, Morrill, MacPherson, Franklin & Friel; Thomas S. MacDonald

[57] ABSTRACT

A breathing air replenishment control system for installation on multiple levels in a multiple-level high-rise structure includes a ground level-based air inlet connection remote from the structure for providing a source of compressed air to an air storage subsystem positioned at a first lower level of the structure. A series of air fill control stations are installed at spaced levels in the structure, each station having a compressed air inlet connected to the air storage subsystem. Portable high pressure air storage vessels, suitable for mounting in a fireman's self-contained breathing apparatus (SCBA) are inserted into a pivoted rack/blast container in a station. Each station contains a quick-disconnect for connecting empty vessels and removing compressed air filled vessels from the rack/blast container for remounting on an SCBA. In one embodiment for a low-rise or single story structure such as a mall, stations are located essentially horizontally at relatively widely dispersed key positions in the structure.

23 Claims, 4 Drawing Sheets

BREATHING AIR REPLENISHMENT CONTROL SYSTEM

FIELD OF THE INVENTION

The present invention relates to apparatus for supplying emergency air storage vessels for use with portable self-contained breathing devices used by firefighters and other emergency personnel. These are used at various levels or locations of a multi-level or other structure. More particularly, the invention relates to a pressurized air storage system at a lower level in the structure and a series of storage vessel control stations installed at one or more upper levels in the multi-level structure.

BACKGROUND OF THE INVENTION

It has been recognized for many decades that it is advantageous to have an auxiliary air supply in the vicinity of a fire for use by those fighting a fire. U.S. Pat. No. 1,040,311 shows an air pipe attached to a hose end with a series of small breathing hoods or masks held in the firemen's lips and covering his nasal passages. U.S. Pat. No. 2,299,793 describes a life saving system for use above or below ground, particularly for mines where an air compressor furnishes air to a mixing tank, the air is mixed with oxygen and then routed by manifolds to safety stations. In the event of an emergency, trapped personnel have access to breathing masks thereat connected to the oxygenated air supply. Alarm and communication wires extend from the station to the ground surface. U.S. Pat. No. 2,855,926 illustrates a coin-operated oxygen system including an oxygen tank and face mask. U.S. Pat. No. 4,165,738 describes a life support system for drilling rigs where a plurality of outlet manifolds and face breathing masks are provided at various rig levels, compressed air being furnished from an array of compressed air bottles mounted on a wheel-based trailer parked near the rig. U.S. Pat. No. 4,331,139 shows emergency breathing apparatus in a multi-story building where emergency air is provided from the vent tubes of the waste disposal pipes in the building and communicated to a series of air collectors, filters and attached breathing masks positioned at various levels of the structure. U.S. Pat. No. 4,862,931 describes a system for refilling self-contained breathing apparatus of fireman and other emergency rescue workers in a multi-level building or subway. Compressed air is furnished by hose to an outside first station and then by rigid pipe to inside second station and through each level station to a station at a higher (or lower if a subway) level in the building. The inside stations are provided in the stairwell of the building or subway. The stations permit connection of the tank of a self-contained breathing apparatus to an air pack filling adaptor at the end of a filling hose. Flow of air is from one inside station to the next inside station with air flow controlled to the next station in each preceding station.

SUMMARY OF THE INVENTION

The present invention provides for an air replenishment and control system which is installed at multiple spaced levels in a multi-level structure including a ground level-based air inlet connection; an air storage subsystem positioned at a first generally lower level of the structure and air flow connected to the air inlet connection; a series of air fill control stations provided at spaced generally upper levels of the structure; a compressed air inlet extending into said each of the stations and connecting the stations to the air storage subsystem; at least one a high pressure air storage vessel in each of the stations; a pressure regulator in the stations and attached in-line between the compressed air inlet and the at least one storage vessel for controlling the air pressure therein; and a first quick-disconnect associated with the at least one storage vessel for removing an air-filled storage vessel from the station and inserting an essentially empty storage vessel in place of the removed air-filled storage vessel, the air-filled storage vessel after removal being mountable in a fireman's portable self-contained breathing apparatus.

The air storage subsystem includes a series of high pressure, e.g. about 6000 psi, air-receiving cylinders, which provide an on-site supply of breathable air, and may utilize a breathing air booster pump drivable either directly from the air inlet connection providing a replenishment source of compressed air or by compressed air contained in one or all of the air-receiving cylinders. The storage compressed air in the cylinders augmented by the booster pump provides sufficient air pressure to fill the air flow tubing extending, for example, up to 35 floors of a multi-level structure and sufficient to fill the self-contained breathing apparatus (SCBA) vessels used by the firefighter.

In one embodiment, two SCBA vessels are stored in a rack within a station housing, the rack including a water-containing blast container. The rack and the container are pivotally mounted in the station housing so as to expose the top of the rack outwardly from the housing, facilitating the manual disconnection and removal and the insertion and connection of the SCBA vessels into the rack and housing.

In a preferred embodiment, the control system includes a pneumatic air dispenser in each station connected in-line with the compressed air inlet and properly regulated to an appropriate operating pressure for supplying pressurized air for a fireman's pneumatic work tools such as saws, drills, chipping hammers or jaws of life.

The invention in one embodiment also contemplates providing a ground level-based air inlet connection adjacent to the air storage system or a structural wall or at a remote location somewhat, e.g. 5–20 meters, from the structure. A fire truck or other emergency vehicle can be used to provide an auxiliary supply of breathable air at high compression e.g. about 5000 psi to that connection from an air compressor or compressed air storage system stored on the vehicle. Further, an electrical connection can be made from an electrical generator on the vehicle to supply emergency power to the system via a conduit adjacent to the air inlet connection and running with the air supply tubing up to the upper level stations, which emergency power is completely independent from any normal power source or on-site emergency generators. This emergency power connects to an electrical service unit in the upper level stations, for particular use in the event of failure of the normal electrical service of the multi-level structure.

In a further embodiment, the above described system may be installed in a horizontal orientation for use in a large spread-out building, such as a shopping mall. This allows a firefighter or emergency worker to be resupplied with a filled SCBA at other ground level-located locations well-displaced from the ground level-based air storage subsystem and the ground level-based air inlet connection. In still another embodiment, a low-rise building structure may have a ground-level and, for example, second floor and third floor levels at which the breathing air replenishment control system may be installed with air fill control stations on the ground and upper levels. The essentially horizontally displaced stations may be hundreds of yards from an adjacent station or from the air inlet connection or air storage subsystem, with no intervening access for emergency workers or emergency truck access or egress, particularly in the case of dozens or even hundreds of retail stores side-by-side with common walls and facing other stores or business areas across an aisle.

DETAILED DESCRIPTION

Figure 1:
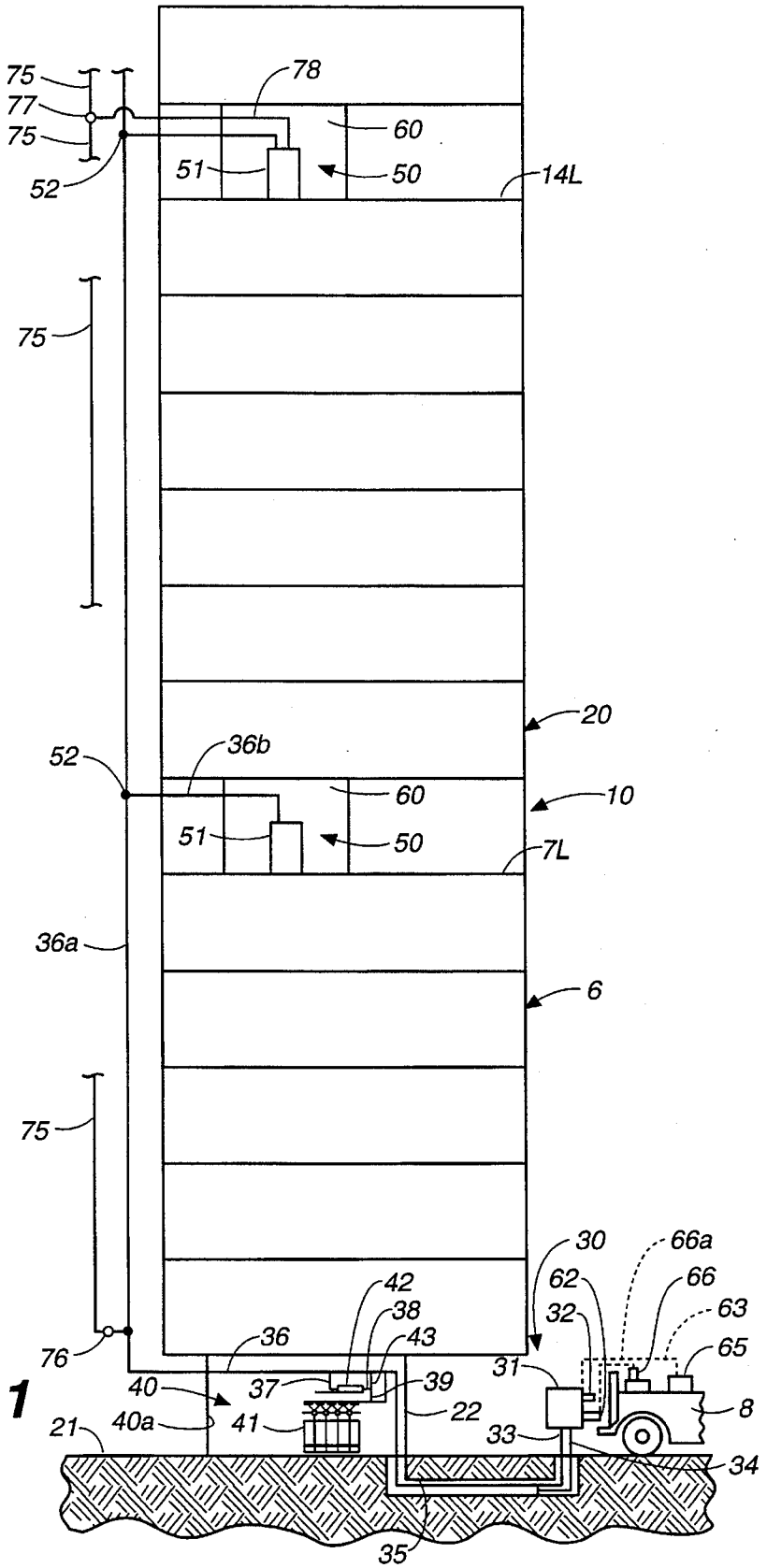
FIG. 1 is a schematic side view of the breathing air replenishment control system of the invention installed in a multi-level structure.

Referring to FIG. 1, the breathing air replenishment and control system 10 of the invention is installed in and exterior to a multi-level structure 20 built-on or into a ground level 21 by a suitable foundation (not shown). A generally ground level-based fire department air inlet connection 30 including a control and feed panel 31 having a compressed air truck connection 32 is preferably mounted at a ground or plaza level displaced from the exterior of the structure 20 or on an outside wall 22 of the structure or a structure annex. Air conveying tubing 33 and conduit 34 which is insulated and sleeved is connected to truck connection 32 and conduit connection 62 and are both preferably routed below grade in a duct 35 to an air storage subsystem 40 located preferably on a ground or plaza level within or immediately adjacent to the building structure. This subsystem is normally contained in a room **40*a*** which may serve as a fire department command center.

The subsystem 40 includes a series of stacked or racked compressed air-receiving storage cylinders 41, for example ten cylinders, a compressed air booster pump 42 and booster piping 43 connected to air conveying tubing 33 and to a tubing extension 36 extending from the booster output line 37. The booster pump 42 is drivable by compressed air from the air inlet connection 32 through inlet line 38 or by an alternative inlet line 39 extending from the air-receiving cylinders 41. The booster pump 42 increases the pressure in tubing 33 downstream from a check valves **33*a* and 33*b* (FIG. 2) so that the tubing extension 36, the vertical tubing 36*a* and horizontal tubing spans 36*b* can be filled with compressed air and still have the desired air pressures at air fill control stations 50. The stations are each in a fire department equipment room 60 located at various building levels, for example, in a 35-story building at levels (floors) 7, 14, 21, 28 and 35. Actual levels 7L and 14L are illustrated. Each of the stations 50 are mounted in a housing 51**.

The stations include a rack and container (FIG. 3) for holding the typical 45 cu. ft. (2215 psi or 4500 psi) or 88 cu.ft. (4500 psi) SCBA vessels used in a fireman's or emergency workers portable self-contained breathing apparatus. Typically, these vessels at the typical volumes will store enough compressed air to give, respectively, about a 30 minute or 60 minute air supply to the worker. It is desired in high rise building fire-fighting or other emergency incident such as a hazardous chemical discharge that the removable and essentially empty used SCBA vessels be refilled within an approximate span of two minutes. In practice, a separate work person mans the fill control station, taking filled vessels from the housing 51, helping the emergency worker to demount his expended vessel, placing a filled vessel into the worker's SCBA pack and inserting the empty vessel back into the rack in the housing for refilling. The particular mounting, remounting and refilling technique depends on the practices of the particular fire department or agency.

A three-way junction valve 52 (FIG. 1) is provided in tubing **36*a* at each horizontal span 36*b* leading to housing 51. Valve 52 may be operable manually or by pneumatic air in the system or by electrical impulse from the command center 40*a* and at the stations 50 so that a particular station, say at level 14L, can be bypassed in the event, for example, of fire danger or physical damage in the associated equipment room 60. Compressed air still can continue to flow to another level such as level 21 (not shown), or levels thereabove. Tubing 36*b* and its associated conduit 34 may be routed in a level ceiling cavity. Typically, tubing 36*a* and associated conduit and valve 52 will extend upwardly in a vertical pipe chase or enclosure particular to the design of the high rise structure. Installation in or adjacent to stair wells is best avoided due to other structures in the stair wells and the high level of activities in the stair wells during an emergency situation. For illustration purposes, the adjacent conduit 34 is only shown extending from the air inlet connection 30 to a location in the below grade duct 35. In practice, it extends all the way to each station 50**.

The above described bypass valving may be employed when firefighters are fighting a fire from a location below the fire and do not need SCBA vessel replenishment at levels above the fire. However, on occasions, it is necessary to fight a fire from above a fire, for example, the firefighter arriving at the fire by helicopter transport to the roof of the structure. In this case, a second separate compressed air line 75 may extend parallel to line **36*a* in the vertical pipe chase in the building or in a separate pipe chase or housing. In FIG. 1, tubing 36*a*, line 75 and associated valves are shown outside the structure 6 so as to avoid drawing clutter. An on-off valve 76 connects line 75 to line 36*a* at a lower level and a three-way valve 77 is provided to either connect line 75 to a line 78** feeding compressed air to an intermediate station(s) or direct to the topmost station (not shown) in the structure.

Returning to the air inlet connection 30 and the control and feed panel 31, a fire truck or emergency vehicle 8 having an on-board air compressor 65 is hooked up by line 63 to the inlet air connector 32 and an on-board electrical generator 66 is hooked up by line **66*a* to an electrical connector 62 to feed electrical power to an electrical power cable (not shown) in conduit 34. The panel 31 is preferably remote from the building structure 6** so that any debris or water falling from the structure will not fall on the truck or its operators.

The compressed air to be furnished to the air inlet connection and in seriatim to the tubing and lines, air storage subsystem, booster pump and the control stations is clean and dry air in accord with the National Fire Protection Standard. If the storage in the air-receiving cylinders in the air storage subsystem is depleted, the compressed air from the air inlet connection 30 may be pumped directly through tubing 33, 36, **36*a*, and 36*b* or line 75 to pressure regulators and vessels in the control stations 50**.

Figure 2:
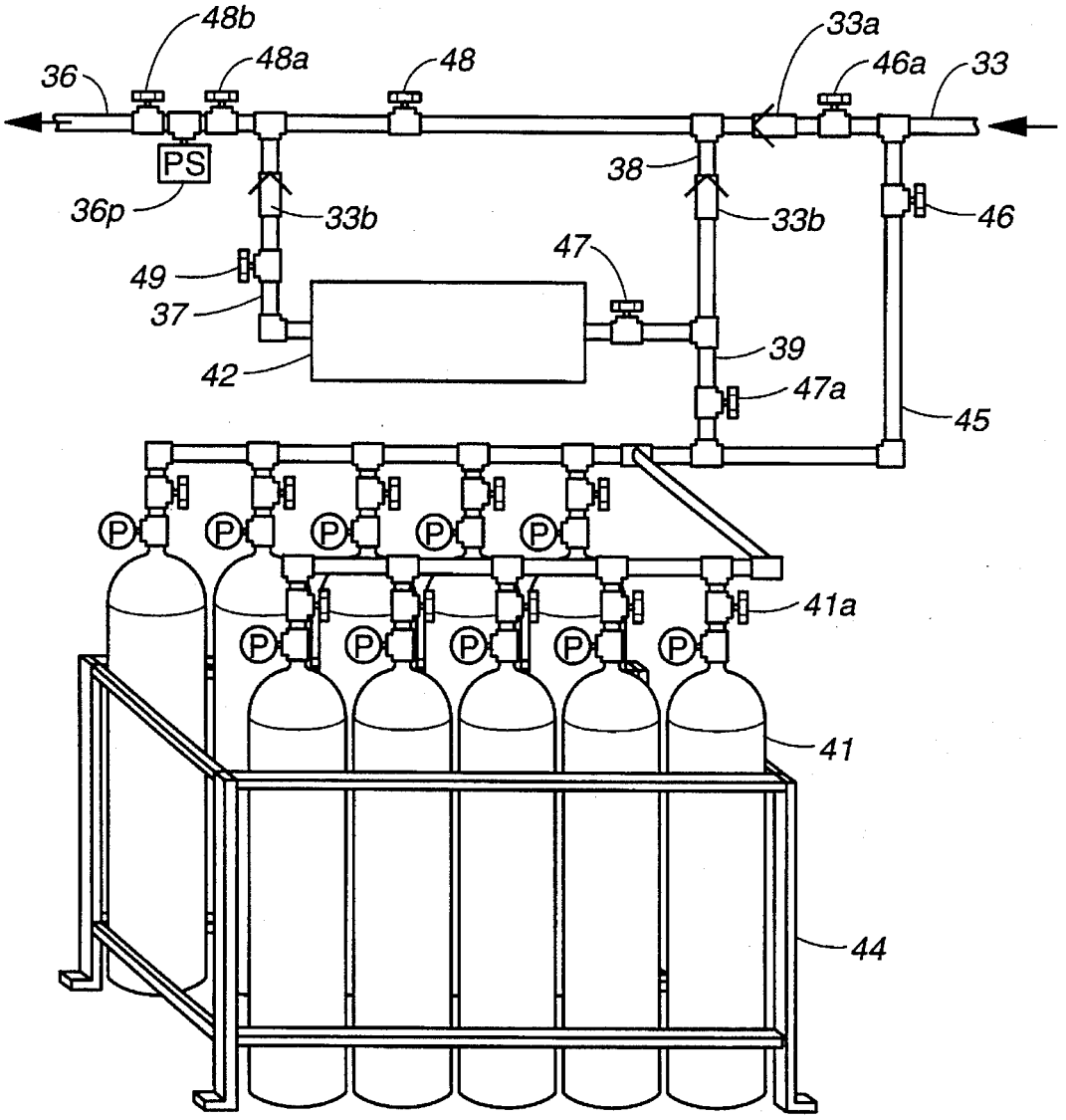
FIG. 2 is a partial perspective view of the compressed air storage and booster subsystem of the invention.

FIG. 2 shows the series of air-receiving cylinders 41 vertically positioned in holding rack 44 and connected in series. Individual on-off cylinder isolation valves, pressure gauges and pressure relief valves are provided on the cylinders as is common. A fill tubing air supply line 45 conveys compressed air from the air inlet connection 30 (FIG. 1) and line 33 through storage system fill valve 46 to the bank of cylinders 41. Appropriate on-off isolation valves 46, 46*a*, 47, 47*a*, 48, 48*a*, 48*b* and 49 allow bypassing of the booster pump 42 or by-passing of the air receiving cylinders. A building system pressure sensor 36*p* extends between isolation valves 48*a* and 48*b*. A low pressure monitor switch 36*p* solenoid-control is utilized at a pre-set pressure, typically 1000 psi, so that if the pressure in the system falls below that pre-set pressure, an alarm located in a fire control center 40*a* annunciator panel will indicates a system fault.

Specifically, in one mode of operation, closure of valves 46, 47, 47*a* and 49 and opening of valves 46*a*, 48, 48*a*, and 48*b* allow for by-passing the air-receiving cylinders 41 and booster pump 42, such that compressed air from the air inlet connection 30 through line 33 goes direct to line 36 through check valve 33*a* and to the upper level control stations 50. In a second mode of operation, valves 46*a* and 47*a* are closed and valve 46 opened to fill cylinders 41 through open valves 41*a* on the cylinders. In a third mode prior to a fire truck connecting up to the air inlet connection 30, valve 46 and booster bypass valve 48 are closed and valves 47, 47*a*, 49, 48*a* and 48*b* are opened to convey pressurized air from open valved cylinders through the booster pump 42 to line 36 and the upper level control stations. In still another mode valves 46, 46*a*, and 47 may be closed and valves 47*a*, 48, 48*a* and 48*b* opened to permit air flow direct from the cylinders 41 to line 36 bypassing the booster pump 42. Check valve 33*b* prevents air flow to booster pump 42. In an additional mode, air pressure from the vehicle may be provided through the booster pump to augment the pressure from the vehicle by appropriate closing and opening of the valves.

Figure 3:
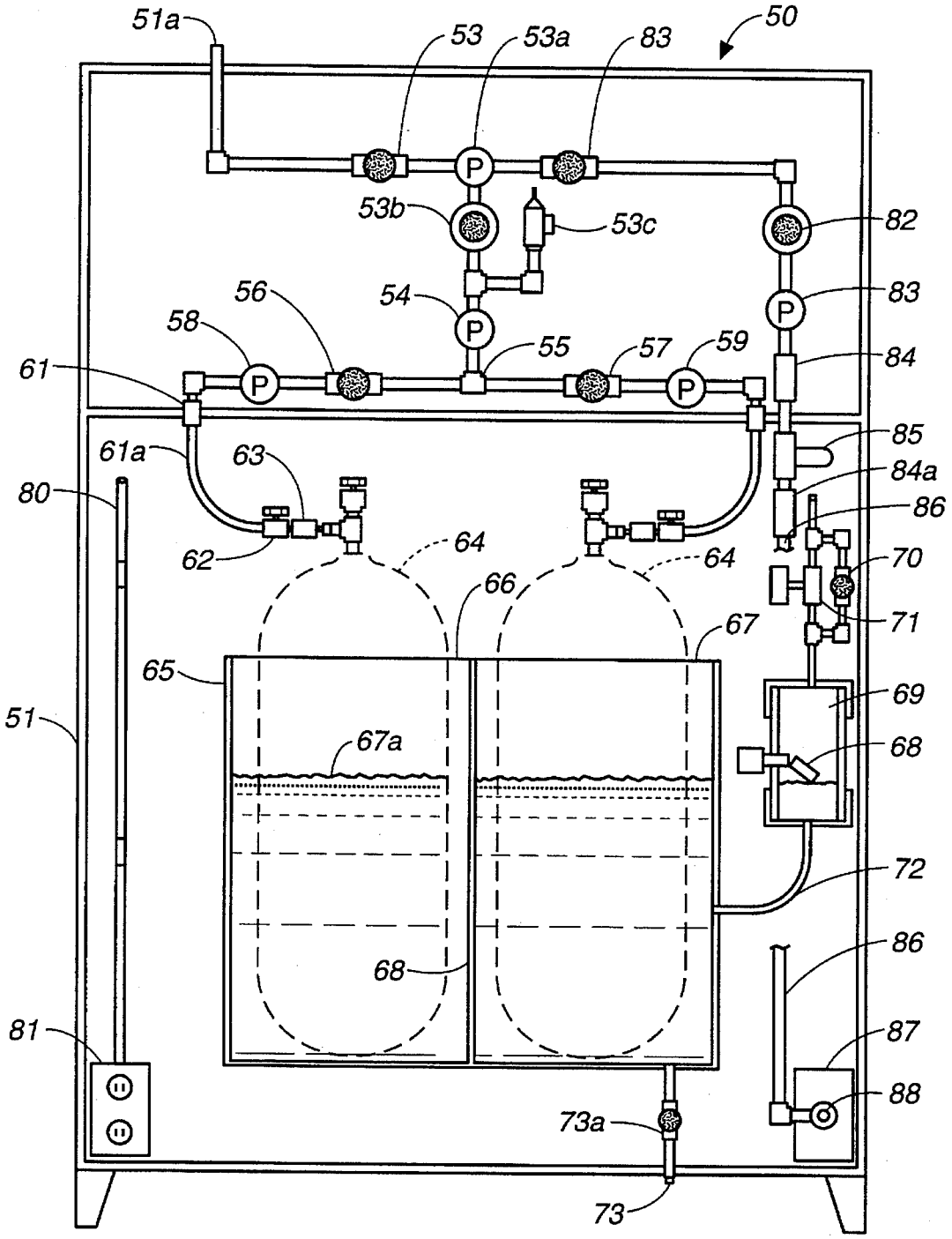
FIG. 3 is a front interior view of the air fill control stations of the invention.

FIG. 3 shows the interior configuration of the upper level control stations 50. An air service inlet 51*a* extending through housing 51 receives compressed air from an opened three-way valve 52 (FIG. 1) and line 36*b* and directs the compressed air to a station isolation valve 53 and a system pressure gauge 53*a* with an adjustable pressure regulator 53*b* with a downstream pressure relief valve 53*c* to a pressure gauge 54 having a branched outlet 55. The pressure is adjustable to the filling pressure of the particular SCBA vessels being filled. Outlet 55 leads to a pair of fill valves 56 and 57 and fill pressure gauges 58 and 59, respectively, through bulkhead connections 61 to vessel fill hoses 61*a* connected to fill bleed valves 62 and to SCBA vessels fill adaptors 63 herein also called a quick disconnect to which the SCBA vessels 64, normally provided by the local fire department, are quick connected and disconnected. The vessels 64 are mounted in a rack 65 including an about three mm thick (0.119 inch—11 Gauge) steel blast container 66 having an open top 67 and a center perforated plastic separator 68 between a pair of vessels 64.

The container 66 is filled with water to level 67*a* upon arrival of the fire department. The firemen have a supply of vessels 64. A water fill float switch 68 in a level control reservoir 69 is provided to control level 67*a* covering a majority of the height of the vessels 64. A manual water fill valve 70 and if desired, a solenoid water fill valve 71 are provided to afford manual or automatic entry of water to the container through flexible water fill hose 72. After a fire or emergency event, water in the container may be drained through valve 73*a* to drain 73 to prevent corrosion to the container.

The air control station also contains an emergency power conduit inlet 80 from conduit 34 (FIG. 1) and a 110 volt emergency power outlet 81. In addition, a pneumatic air shut-off valve 83 is flow connected to the system pressure gauge 53*a* so as to provide in an open position, compressed air to a pneumatic air pressure regulator 82 and gauge 83 then through check valve 84, air filter 85 and check valve 84*a* through line 86 to a pneumatic air mounting box 87 containing a pneumatic air quick coupler disconnect 88. Thus, the fire department has pressured air controlled from an initial about 6000 psi to about 200 to 300 psi, the latter range being useful for powering fireman or emergency crew tools such as saws, hammers or jaws of life by simply connecting the tool hose connector (not shown) into quick coupler disconnect 88.

In one embodiment, the components illustrated in FIGS. 2 and 3 are as follows:

| DEVICE | MODEL NO. | MANUFACTURER |
|---|---|---|
| 46 etc. 53, 56, 57, 83 | 1 RS6 | Whitey Co. Highland Heights, Ohio |
| 36p | J614 | United Electric Controls Co., Watertown, MASS. |
| 53a 54, 58, 59, | Series 500 | NOSHOK, Inc. Middleburg Heights, Ohio |
| 42 | AGT | Haskel, Burbank, California |
| 53B, 82 | 1120 | Aqua Environment Co. Stimson Beach, California |
| 53c | 504 | Aqua Environment Co. Stimson Beach, California |
| 85 | 12F 38G | Parker Hannifin Co. |
| 88 | 8AHQ8CY | Parker Hannifin Co. |
| 33a, 33b, 84 | CH8 | NUPRO Co. Willoughby, OH |
| 62 | Aqua 712 | Aqua Environment Co. Stimson Beach, California |
| 63 | 835 or 708 | Aqua Environment Co. Stimson Beach, California |

Figure 4:
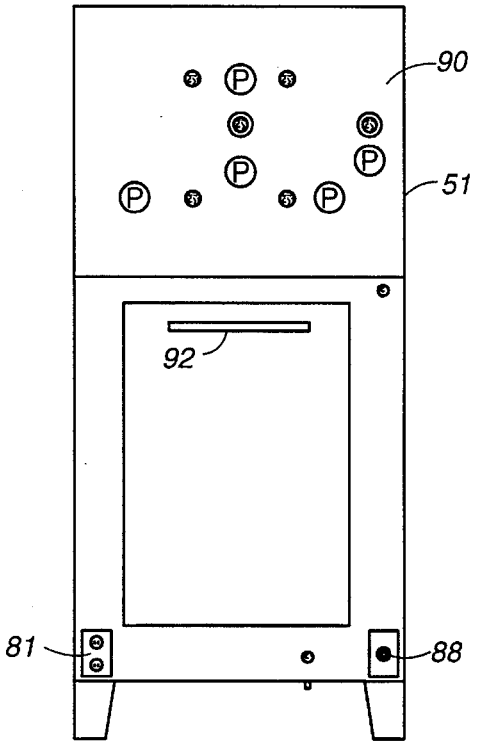
FIG. 4 is a front exterior view thereof.
Figure 5:
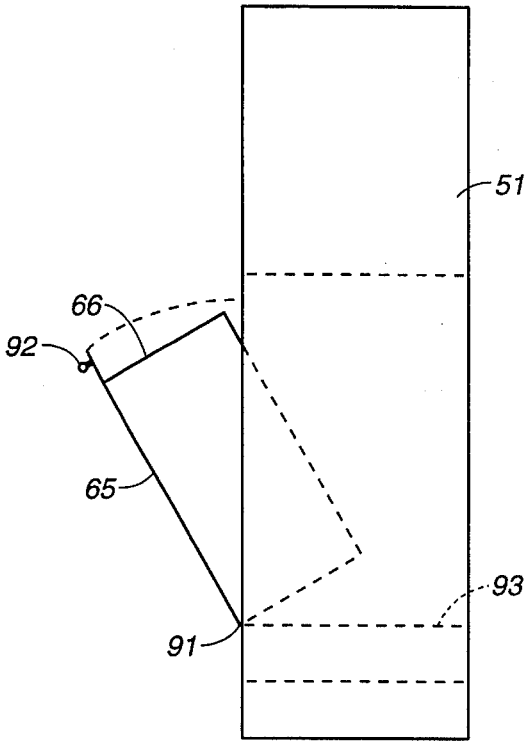
FIG. 5 is an exterior side view thereof.

FIGS. 4 and 5 illustrate the exterior of the housing 51 where controls on panel 90 operate the various valves. The container is pivoted at 91 by pulling on handle 92 to a tilt position of from about 30° from the horizontal housing floor 93 so as to give easy access for the removal and insertion of the SCBA vessels into the container halves. The auxiliary power outlets 81 and pneumatic air disconnect 88 are also shown.

Figure 6:
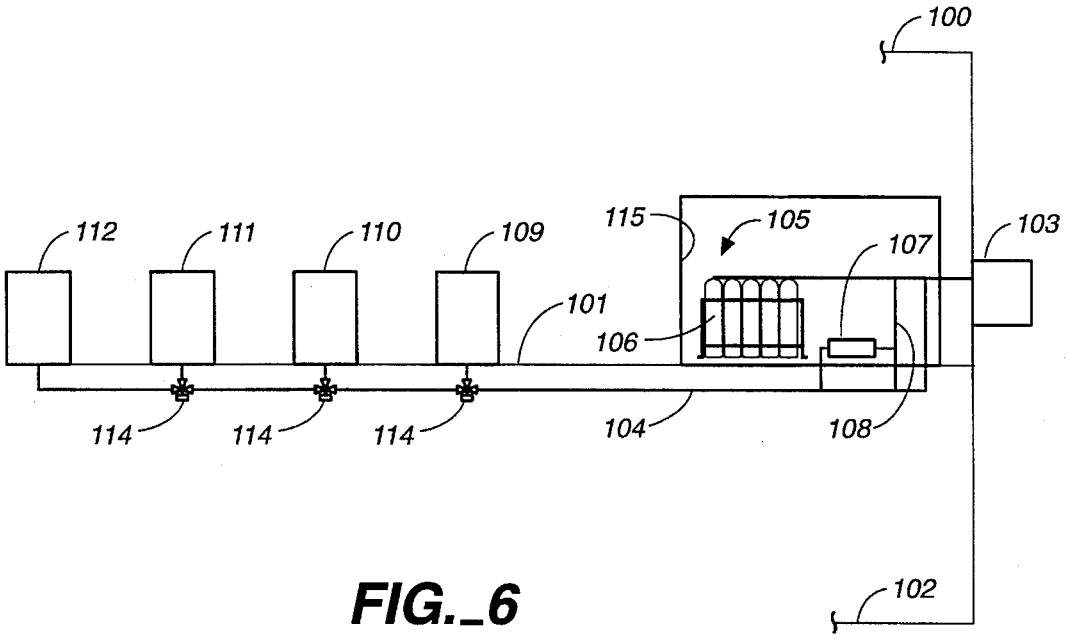
FIG. 6 is a schematic side view of the control system of the invention installed in an essentially horizontal building structure.

FIG. 6 shows an essentially horizontal embodiment of the invention where a building structure 100 is either all contained on one level 101 such as a ground level, or including a basement level 102 or a second or third floor (not shown) or other immediately above floors making up a low-rise building. In such cases, there exist relatively long distances of perhaps hundreds of yards which must be traversed by an emergency worker or firefighter to an emergency vehicle or air cylinder storage area for exchange and/or replenishment of his SCBA vessel. This is particularly true of large industrial buildings with many offices or work areas in large malls with many side-by-side and aisled stores and business establishments. The present invention provides for replenishment stations at widely dispersed but interconnected locations throughout a low-rise essentially horizontal building structure. As in the vertically oriented structure shown in FIG. 1, an air inlet connector 103 is located on or adjacent to the building 100 with access for an emergency vehicle as in FIG. 1. Air flow tubing 104 may be routed at or below grade or in a basement ceiling cavity. An air storage subsystem 105 in a fire department control room 115 containing pressured air storage cylinders 106, a booster pump 107 and piping and valve components 108 (shown in detail in FIG. 2), is normally within the building structure or in an annex thereto. A series of air fill control stations 109, 110, 111 and 112 are spaced horizontally at locations throughout the building either all or level 101 or on an adjacent floor level. Adjacent to each control station are three-way valves 114 in flow connection to any one of the air inlet connection 103, the booster pump 107 or the bank of air storage cylinders 106.

The above description of the preferred and another embodiment of this invention is intended to be illustrative and not limiting. Other embodiments of this invention will be obvious to those skilled in the art in view of the above disclosure.

I claim:

1. A breathing air replenishment control system for installation in a building structure having a first level comprising:

an air storage subsystem positioned adjacent to said first level of the building structure;

a series of air fill control stations at spaced locations in the building structure spaced from said air storage system;

a compressed air inlet extending into said each of said stations and connecting said stations to said air storage subsystem;

at least one high pressure air storage vessel in each of said stations;

a pressure regulator in each of said stations and attached in-line between said compressed air inlet and said at least one air storage vessel for controlling the air pressure in said at least one air storage vessel; and a quick-disconnect associated with said pressure regulator and said at least one storage vessel for removing an air-filled storage vessel from said station, an essentially empty storage vessel then being connected to said quick disconnect for refilling said essentially empty storage vessel, the air-filled storage vessel after removal being mountable in a fireman's portable self-contained breathing apparatus.

2. The control system of claim 1 including a storage vessel rack within each station and wherein said at least one storage vessel is stored in the rack within each of said stations.

3. A breathing air replenishment control system for installation in a building structure having a first level comprising:

an air storage subsystem positioned adjacent to said first level of the building structure;

a series of air fill control stations at spaced locations in the building structure spaced from said air storage system;

a compressed air inlet extending into said each of said stations and connecting said stations to said air storage subsystem;

at least one high pressure air storage vessel in each of said stations;

a pressure regulator in each of said stations and attached in-line between said compressed air inlet and said at least one air storage vessel for controlling the air pressure in said at least one air storage vessel;

a quick-disconnect associated with said at least one storage vessel for removing an air-filled storage vessel from said station and inserting an essentially empty storage vessel in place of the removed air-filled storage vessel, the air-filled storage vessel after removal being mountable in a fireman's portable self-contained breathing apparatus;

a storage vessel rack within each station and wherein said at least one storage vessel is stored in the rack within each of said stations;

wherein said rack includes a blast container surrounding a portion of the rack which receives the at least one storage vessel; and means for supplying and controlling a level of water in said container which water essentially surrounds the at least one storage vessel in said rack.

4. The control system of claim 3 wherein two storage vessels are rack mounted in said blast container and further including a perforated separator in said container and extending between said storage vessels.

5. The control system of claim 3 wherein said rack and said container are pivotally mounted in each station such that in a rack-open position said at least one storage vessel is at an about 30° angle with respect to a bottom horizontal floor of said station.

6. The control system of claim 3 including a water supply line; a manual water fill valve connected to the water supply line for filling said container with water; and a solenoid controlled water fill valve for controlling the supply of water.

7. The control system of claim 6 including a level control reservoir between said solenoid controlled fill valve and said container and a water fill float switch in said reservoir for providing a predetermined level of water in said container.

8. The control system of claim 2 wherein each of the stations include a housing and wherein each of said racks is pivotally mounted in a respective housing and pivotable to a position outside the respective housing to allow removal and positioning of said storage vessels in said racks.

9. The control system of claim 1 wherein said air storage subsystem includes a series of air-receiving cylinders and a breathing air booster pump, said pump being driven by air from one of said cylinders and boosting the pressure of air from the cylinders to fill the at least one storage vessel in said stations.

10. The control system of claim 9 further including a ground-level based air inlet connection remote from the building structure and in flow connection to said air storage subsystem for providing a source of compressed air to said air storage subsystem.

11. The control system of claim 10 further including piping and valve means for bypassing air flow from said air inlet connection to said air-receiving cylinders and directing air flow direct from said air inlet connection to said stations.

12. The control system of claim 1 further comprising a pneumatic air dispenser in said stations connected in-line with said compressed air inlet for supplying pressurized air for a pneumatic work tool.

13. The control system of claim 1 further including a mobile emergency vehicle having an air compressor mounted thereon and wherein said compressed air inlet is connected at said air inlet connection to the air compressor on the mobile emergency vehicle.

14. The control system of claim 1 further including an electrical power outlet in each of said stations and a mobile emergency vehicle having an electrical generator mounted thereon, said outlet being powered by the electrical generator independent from the building structure and contained on the mobile emergency vehicle located at a position exterior of the building structure; and an air inlet connection adjacent to the building structure in flow connection to said air storage subsystem.

15. The control system of claim 1 including air-receiving cylinders in said air storage subsystem and an air compressor for supplying auxiliary supply of compressed air of at least approximately 6000 psi to said air-receiving cylinders in said air storage subsystem and further including a pressure reducer in said stations for supplying a reduced air pressure to the storage vessels in said stations of from about 2200 psi to about 4500 psi.

16. The control system of claim 1 wherein said building structure has multiple levels and the locations of said stations are on different multiple levels in the building structure.

17. The control system of claim 16 including air flow tubing extending through said air storage subsystem and through the multi-level building structure to all of said stations, said compressed air inlet of each of the stations being in flow connection directly with said air flow tubing at a junction at each spaced upper level of the building structure and wherein a three-way control value is positioned in line at each of said junctions for passing pressurized air flow to one of said stations at a particular upper level.

18. The control system of claim 16 further including a rack within each of said stations and wherein said storage vessels are stored in the rack within each of said stations.

19. A breathing air replenishment control system for installation in a building structure having a first level comprising:

an air storage subsystem positioned adjacent to said first level of the building structure;

a series of air fill control stations at spaced locations in the building structure spaced from said air storage system;

a compressed air inlet extending into said each of said stations and connecting said stations to said air storage subsystem;

at least one high pressure air storage vessel in each of said stations;

a pressure regulator in each of said stations and attached in-line between said compressed air inlet and said at least one air storage vessel for controlling the air pressure in said at least one air storage vessel;

a quick-disconnect associated with said at least one storage vessel for removing an air-filled storage vessel from said station and inserting an essentially empty storage vessel in place of the removed air-filled storage vessel, the air-filled storage vessel after removal being mountable in a fireman's portable self-contained breathing apparatus;

wherein said building structure has multiple levels and the locations of said stations are on different multiple levels in the building structure;

further including a rack within each of said stations and wherein said storage vessels are stored in the rack within each of said stations;

wherein said rack includes a blast container surrounding a portion of the rack which receives the at least one storage vessel;

means for supplying and controlling a level of water in said container; and wherein the water essentially surrounds the at least one storage vessel in said rack.

20. The control system of claim 1 wherein said building structure comprises a building of at least one story and the locations of said stations are at spaced locations essentially horizontally displaced from said air storage system.

21. The control system of claim 1 further including an air inlet connection accessible from outside the building structure and air tubing extending from said air inlet connection to said air storage subsystem;

and wherein said air flow tubing is routed below grade to said air storage subsystem.

22. The control system of claim 1 further including a continuous span of compressed air-containing tubing extending from said air storage subsystem to said stations at a location exterior to said stations and wherein each of said compressed air inlets are connected from said tubing directly into said stations.

23. The control system of claim 22 including a three-way valve in said tubing at a junction of said tubing and a compressed air inlet such that an upstream station may be by-passed upon operation of said valve.

* * * * *